United States Patent [19]

Fujiwara et al.

[11] Patent Number: 4,682,877

[45] Date of Patent: Jul. 28, 1987

[54] ELECTROPHOTOGRAPHIC COPYING APPARATUS WITH A SELECTING MEANS OF MAGNIFICATION CHANGING ELEMENTS

[75] Inventors: Katsuyoshi Fujiwara, Osaka; Yoshihisa Miwa, Nara; Shoichiro Yoshiura, Yamatokoriyama, all of Japan

[73] Assignee: Sharp Kabushiki Kaisha, Osaka, Japan

[21] Appl. No.: 768,705

[22] Filed: Aug. 23, 1985

[30] Foreign Application Priority Data

Aug. 31, 1984 [JP] Japan ..... 59-183256

[51] Int. Cl.[4] ..... G03G 15/00

[52] U.S. Cl. ..... 355/3 R; 355/3 SH; 355/55

[58] Field of Search ..... 355/3 R, 3 SH, 14 SH, 355/55.57

[56] References Cited

U.S. PATENT DOCUMENTS

| | | | |
|---|---|---|---|
| 4,277,163 | 7/1981 | Ikesue et al. | 355/57 X |
| 4,341,460 | 7/1982 | Kohyama | 355/14 SH |
| 4,505,579 | 3/1985 | Furuichi | 355/55 |
| 4,575,227 | 3/1986 | Ito et al. | 355/56 |
| 4,585,332 | 4/1986 | Shenoy | 355/3 SH |
| 4,588,289 | 5/1986 | Imoto | 355/57 |

*Primary Examiner*—R. L. Moses

*Attorney, Agent, or Firm*—Birch, Stewart, Kolasch & Birch

[57] ABSTRACT

An electrophotographic copying apparatus is disclosed, which is provided with an original document size detector for detecting the size of an original document placed on a document platform. Further provided is a selector for selecting various magnification changing elements which calculate and select, on the basis of the size of the original document detected by the original document size detector and, the predetermined size of copy paper or the predetermined magnification ratio, a proper magnification ratio when the size of copy paper is predetermined, or a proper size of copy paper when the magnification ratio is predetermined. In the case that either or both of the original document and the copy paper are capable of being placed in such manner that the longitudinal direction thereof is brought in either a crossing or parallel relation with respect to the exposure scanning direction, an indicator for changing the direction of placement of the original document which indicates to change the direction of placement of the original document to such that the magnification ratio is larger or the image forming area does not exceed the size of the copy paper.

1 Claim, 11 Drawing Figures

| D | 06 | 11 | 16 | 24 | 33 | 3A | 4D |
|---|---|---|---|---|---|---|---|
| | x0.70 | x0.81 | x0.86 | x1.00 | x1.15 | x1.22 | x1.41 |

magnification

ELECTROPHOTOGRAPHIC COPYING APPARATUS WITH A SELECTING MEANS OF MAGNIFICATION CHANGING ELEMENTS

BACKGROUND OF THE INVENTION

1. Field of the Invention

The present invention relates to an electrophotographic copying apparatus equipped with a magnification changing copying function, and more particularly to an electrophotographic copying apparatus provided with an original document size detecting means and a selecting means of magnification changing elements so that either the size of copy paper to be copied or the magnification ratio is automatically selected or adjusted.

2. Description of the Related Art

There have been many kinds or types of electrophotographic copying machines introduced into the market which are able to copy with changing magnification ratios. The magnification changing copying function as referred to above is such that an image of an original document placed on an original document platform is enlarged or reduced in size for copying in accordance with the predetermined magnification ratio. It is necessary, therefore, in order to effectively work the magnification changing copying function, to determine various elements or factors requiring the change of the magnification ratio which comprise the size of an original document, the magnification ratio and the size of copy paper to be copied on.

For example, one of the conventional electrophotographic copying machines has an original document size detection device provided below the original document platform which automatically detects the size of the original document placed on the platform, so that the operating steps required of an operator necessary to input the above-described magnification changing elements are simplified. Further, such an electrophotographic copying machine has also been proposed equipped with a selecting device of various magnification changing elements for calculating and selecting a proper magnification ratio or a proper size of copy paper based on the size of the original document detected by the original document size detecting device and, the size of the copy paper or the magnification ratio inputted by the operator.

However, in the prior art electrophotographic copying machines, in the case where the size of the original document or of the copy paper is set less than half the size of the largest paper usable for the copying machine, larger and smaller two magnification ratios may become selectable if the direction of placement of the original document or that of supply of the copy paper is changed, and there may develop the case where the image forming area is larger than the size of the copy paper.

More specifically, in FIG. 5, there is seen an original document platform having A3 for the largest size of paper to be copied thereon. If an original document of A4 size is to be placed on the platform, it is possible for the original document to be placed on the platform with its longitudinal direction crossing the exposure scanning direction (an arrow A) or parallel to the exposure scanning direction. When this original document of A4 size is to be copied on copy papers of A3 size, in the case where the longitudinal direction of the original document is brought into parallel relation to the exposure scanning direction, that is, in the case of A4R, the magnification ratio of 1.41 is selected by the selecting device of the various magnification changing elements. On the contrary, in the case where the longitudinal direction of the original document is placed in the direction crossing the exposure scanning direction the magnification ratio of equal size is selected and accordingly, the image of A4 size is formed on half of the copy paper of A3 size, resulting in such inconvenience that the magnification changing copying function cannot be effectively utilized. Moreover, in the case where the longitudinal direction of the original document is placed in the direction crossing the exposure scanning direction and at the same time, the operator selects a magnification ratio for an enlarged copy, there is a possibility that the image becomes larger than the copy paper selected by the selecting device by the use of the size of the original document and the magnification ratio, also resulting in the inconvenience that the magnification changing copying function cannot be effectively utilized.

SUMMARY OF THE INVENTION

The present invention has been developed with a view to substantially solving the above-described inconveniences inherent in the prior art electrophotographic copying machines, and has for its essential object to provide an improved electrophotographic copying machine which can prevent poor copying resulting from the fact that the direction of placement of an original document or the direction of supply of copy paper is improper, and which can effectively utilize the magnification changing copying function, while improving the operation efficiency.

In accomplishing this and other objects of the present invention, there is provided an improved electrophotographic copying apparatus provided with an indicating means which signals the need to change the direction of placement of the original document, in the case when either one or both of the original document and the copy paper is capable of being placed in such a manner that the longitudinal direction thereof is brought in either a crossing or a relationship with respect to the exposure scanning direction, such that the magnification ratio becomes larger such that the image forming area is not larger than the size of the copy paper.

In the construction as described hereinabove, according to the present invention, poor copying due to the improperness of the direction of placement of the original document or the direction of supply of copy paper can be prevented before it happens and, the magnification changing copying function can be utilized to the utmost of its capability. Furthermore, the copying apparatus of the present invention is advantageous in that it can improve the operation efficiency thereof.

BRIEF DESCRIPTION OF THE DRAWINGS

This and other objects and features of the present invention will now become apparent from the following description taken in conjunction with one preferred embodiment thereof referencing the accompanying drawings, throughout which like parts are designated by like reference numerals, and in which.

DETAILED DESCRIPTION OF THE INVENTION

Figure 1A:
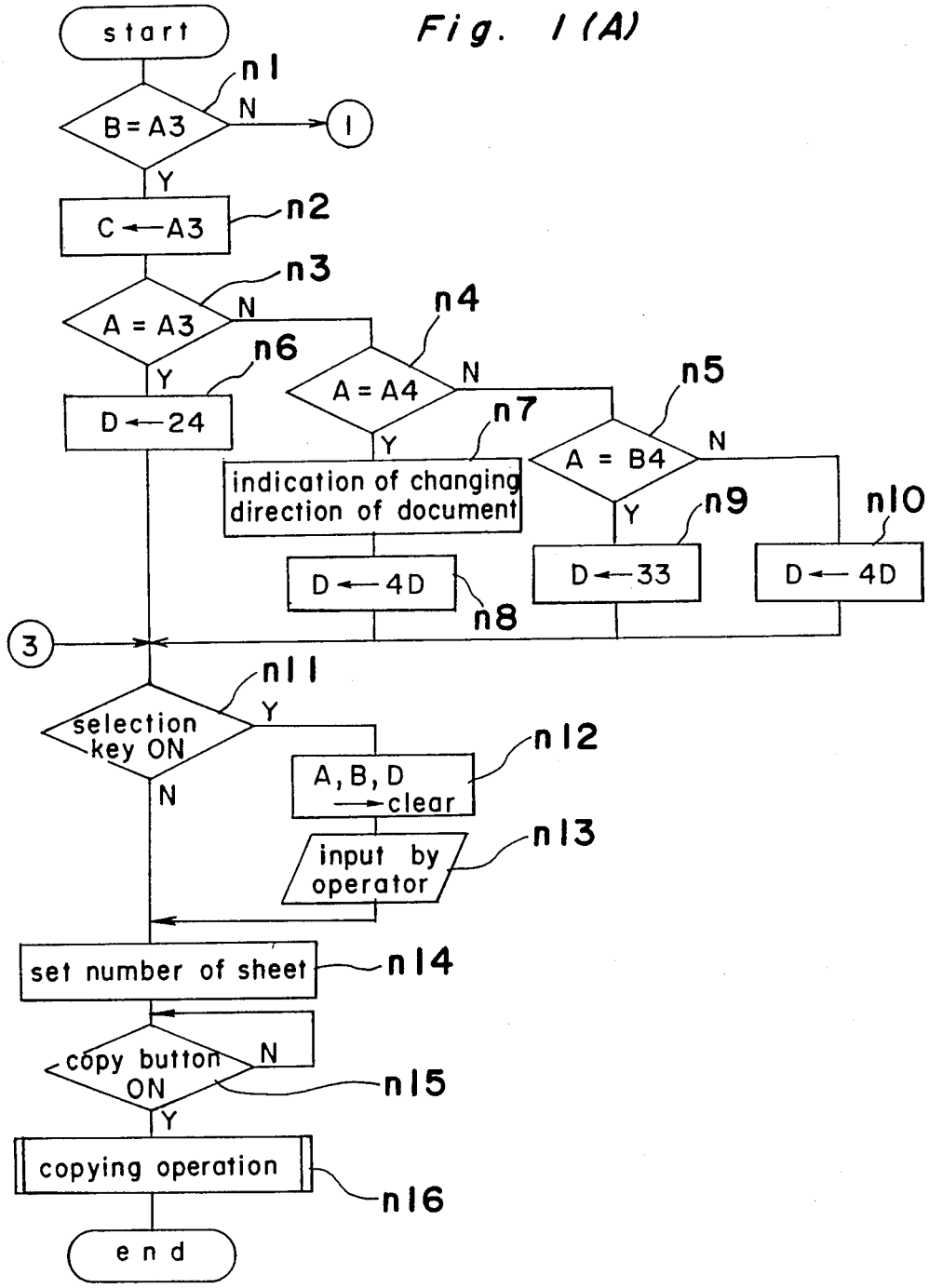
FIGS. 1(A)-(D) and 2(A)-(D) are flow-charts respectively showing the proceedings of an electrophotographic copying apparatus provided with a selecting means of various magnification changing elements according to one preferred embodiment of the present invention.
Figure 1B:
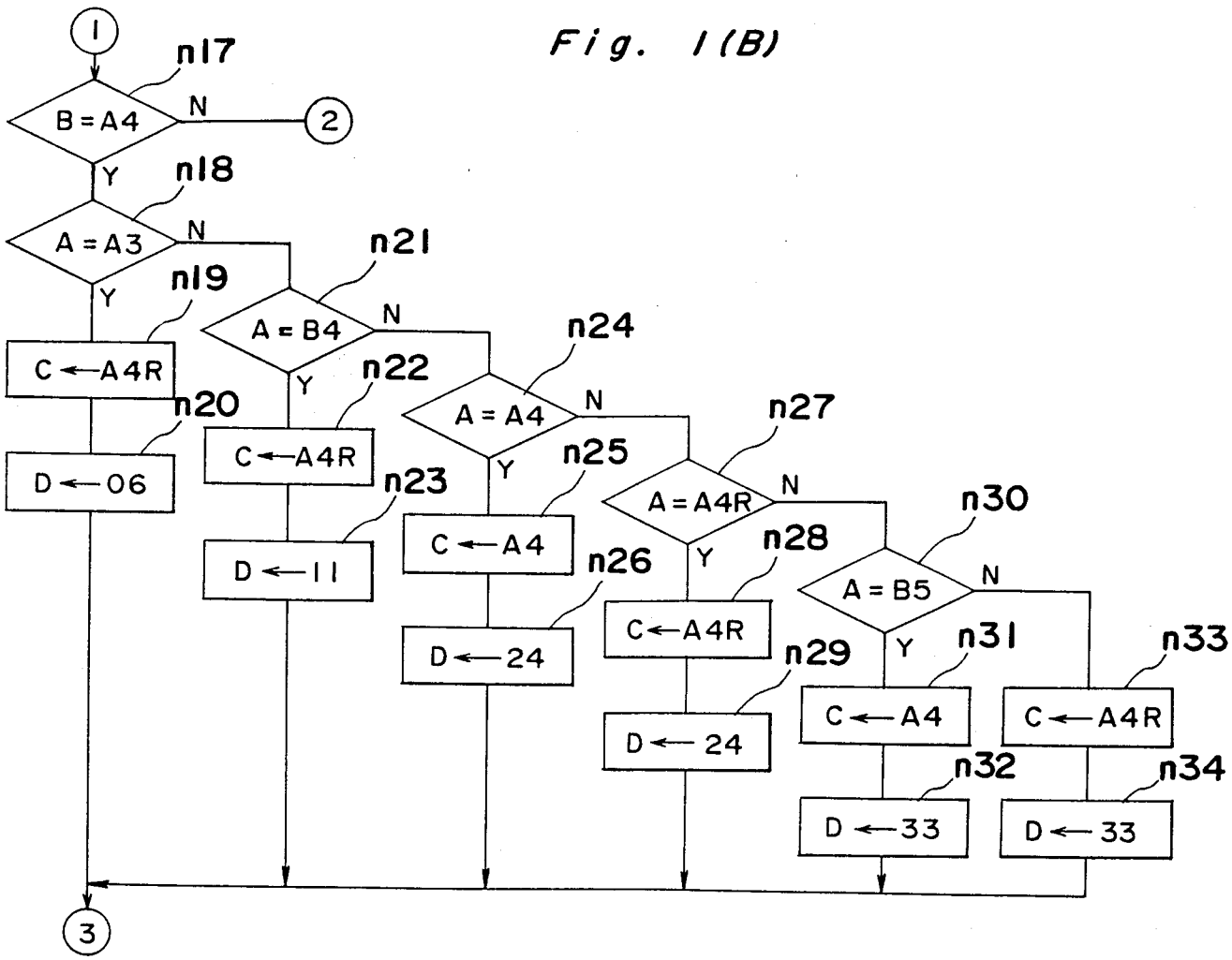
Figure 1C:
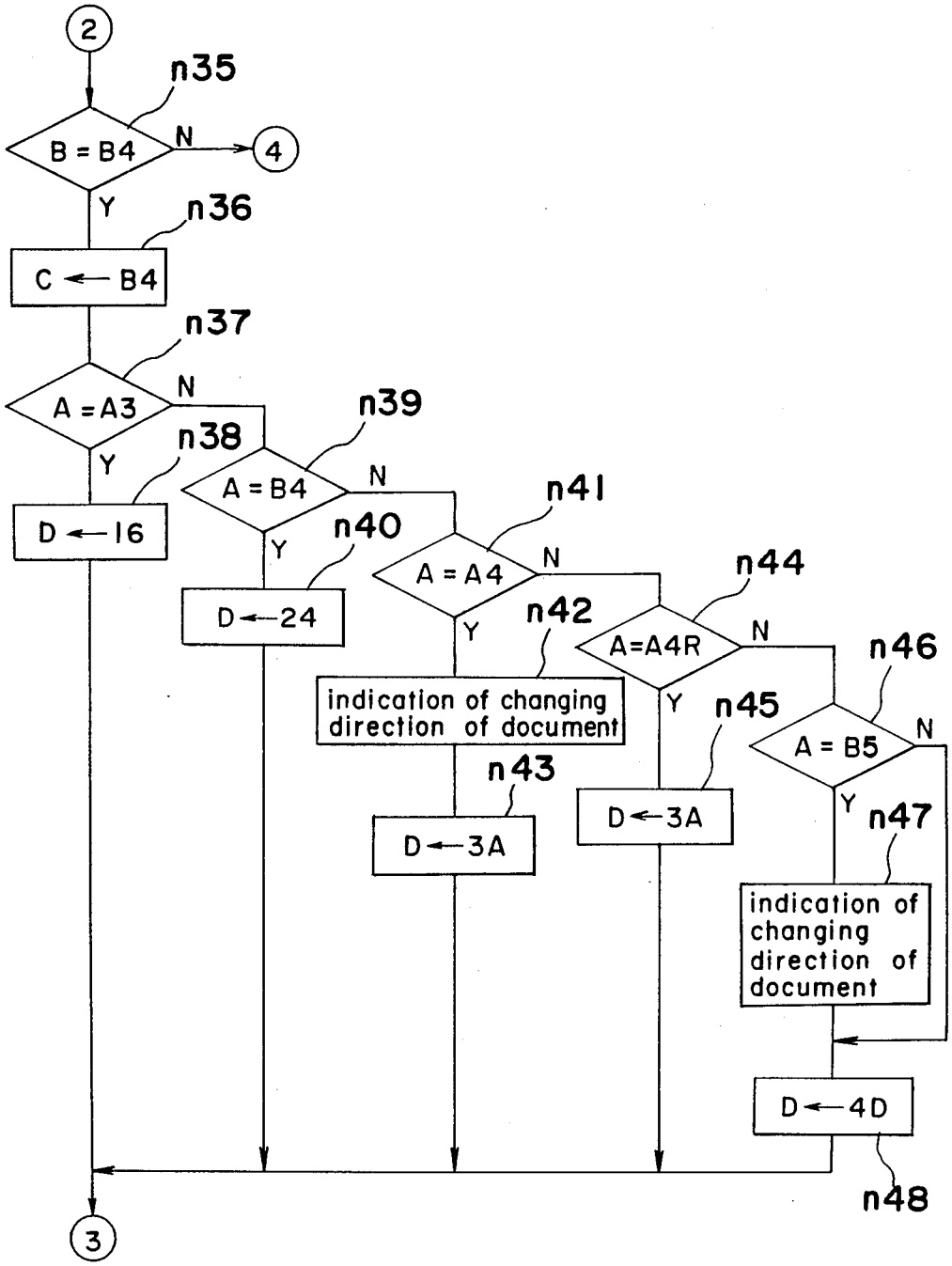
Figure 1:
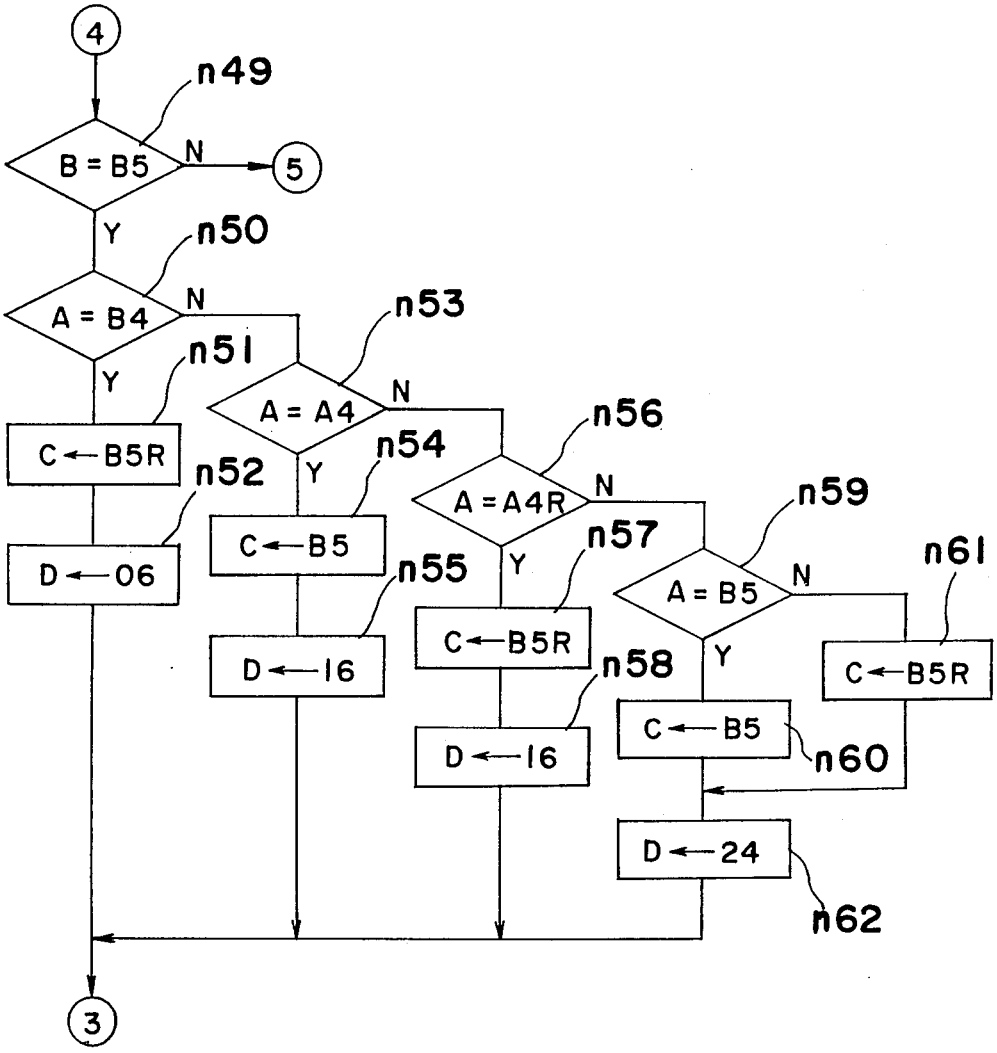
Figure 2:
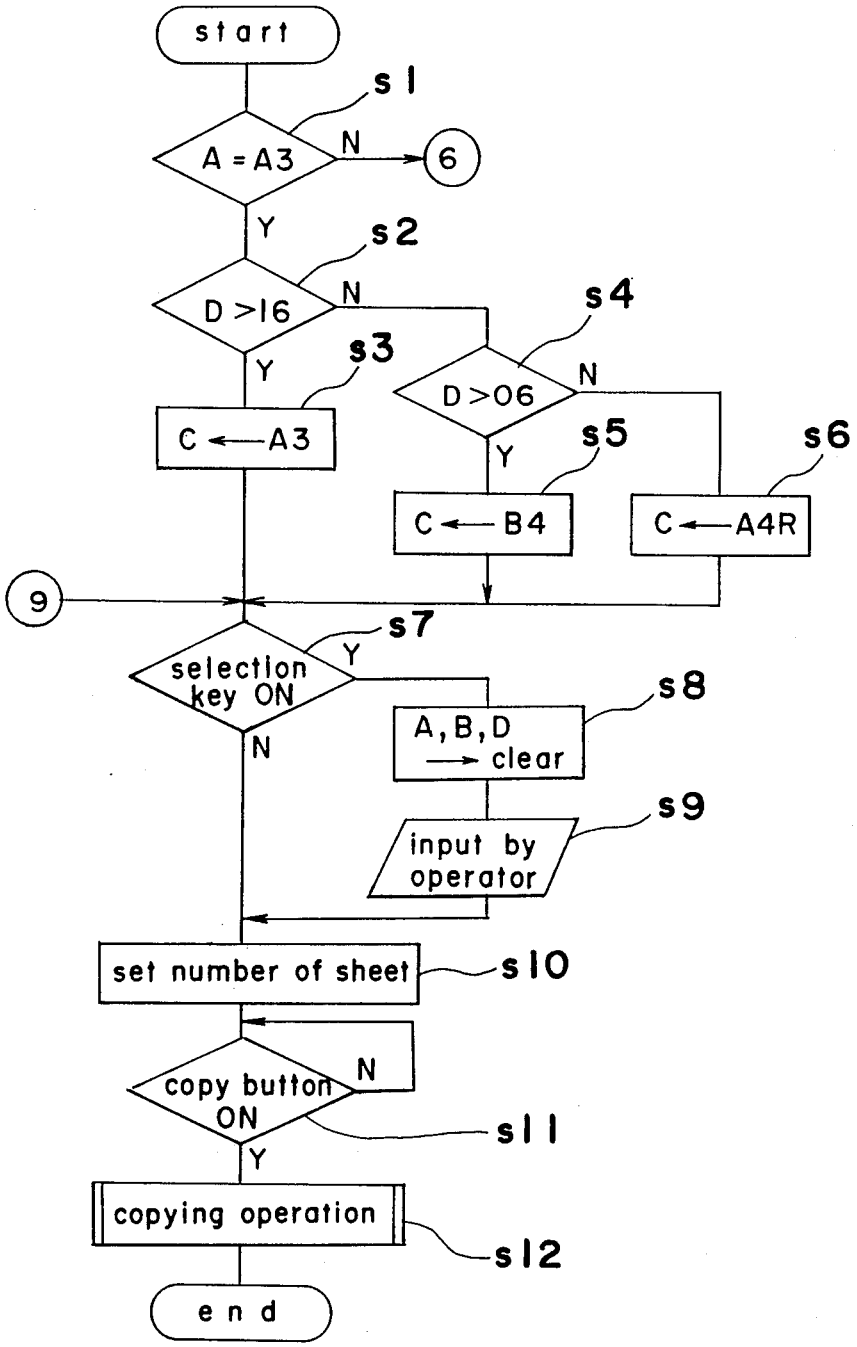
Figure 2B:
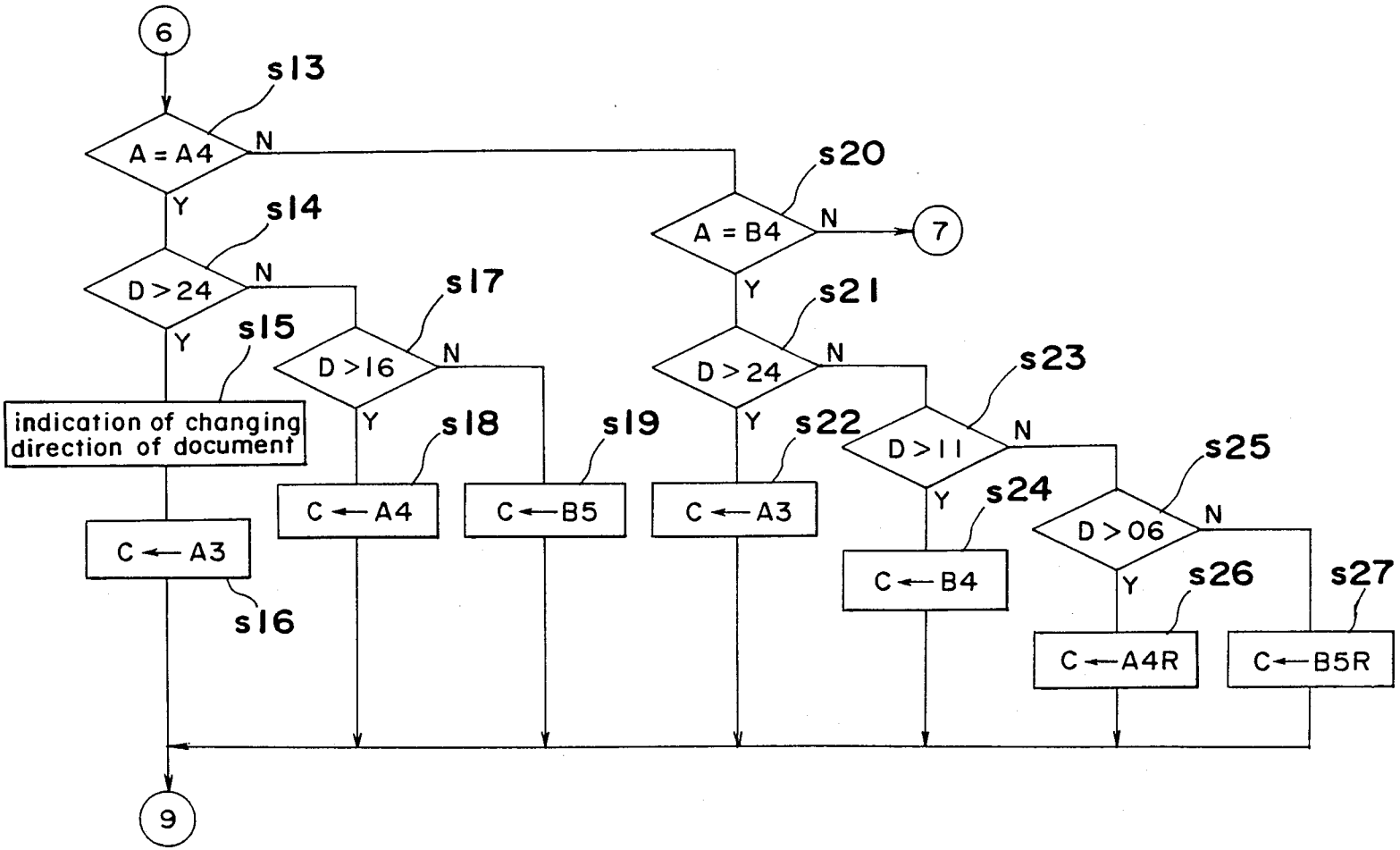
Figures 2C, 3:
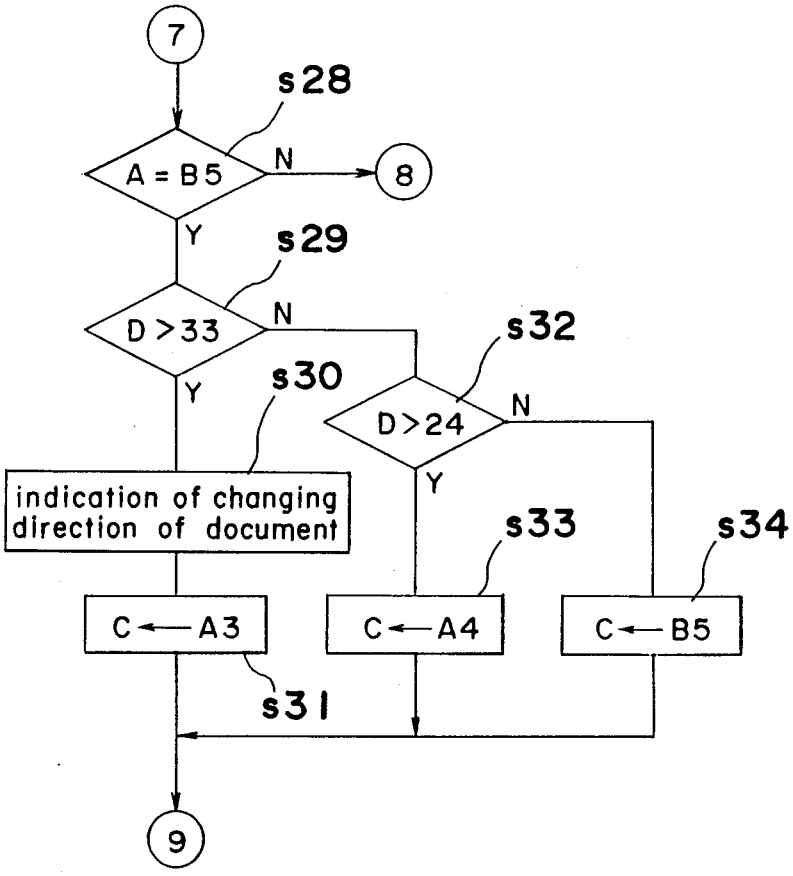
FIG. 3 is a diagram showing the relationship between symbols and values of the magnification ratios employed in the flow-charts of FIGS. 1 and 2.
Figure 2D:
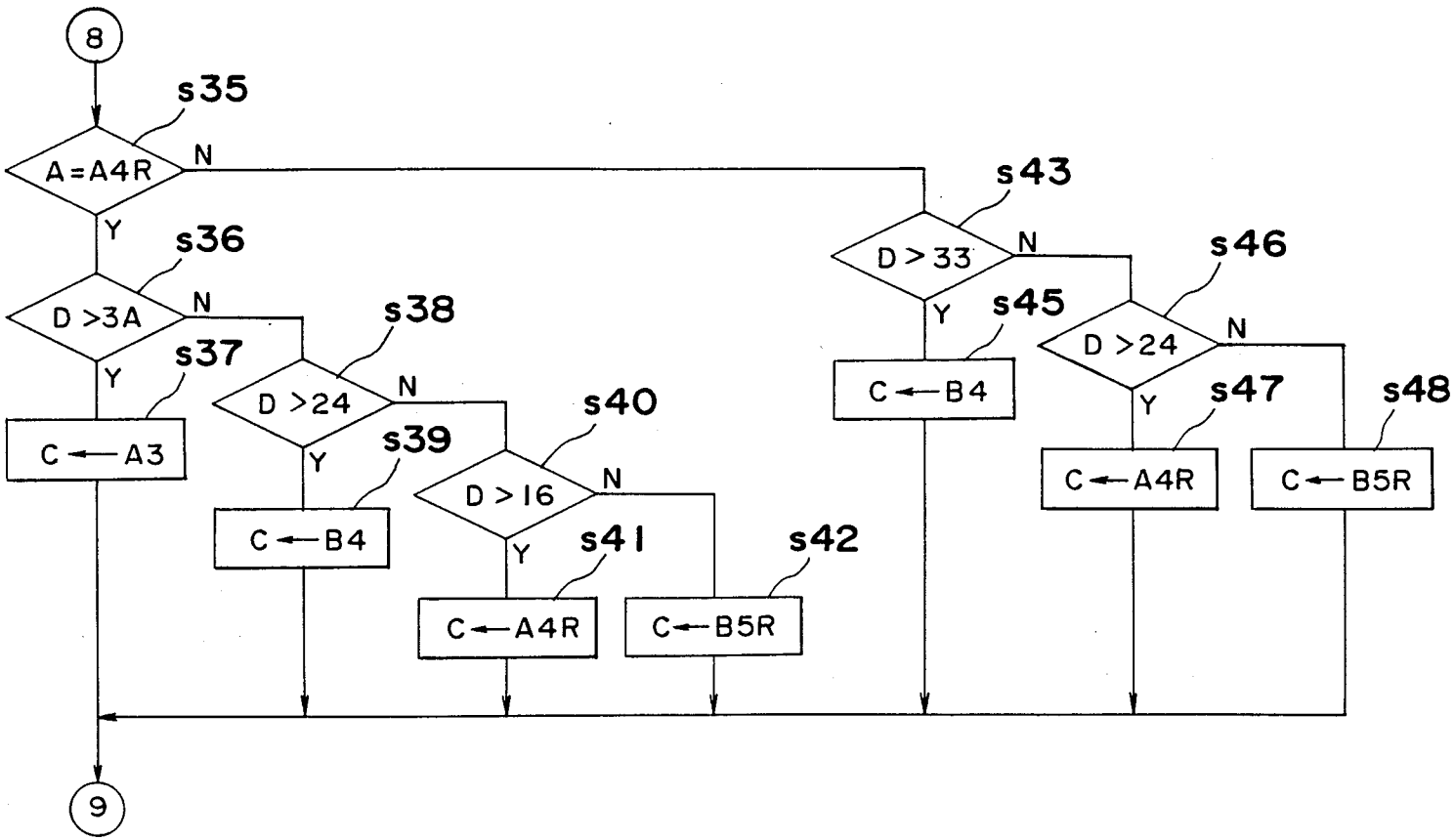
Figure 4:
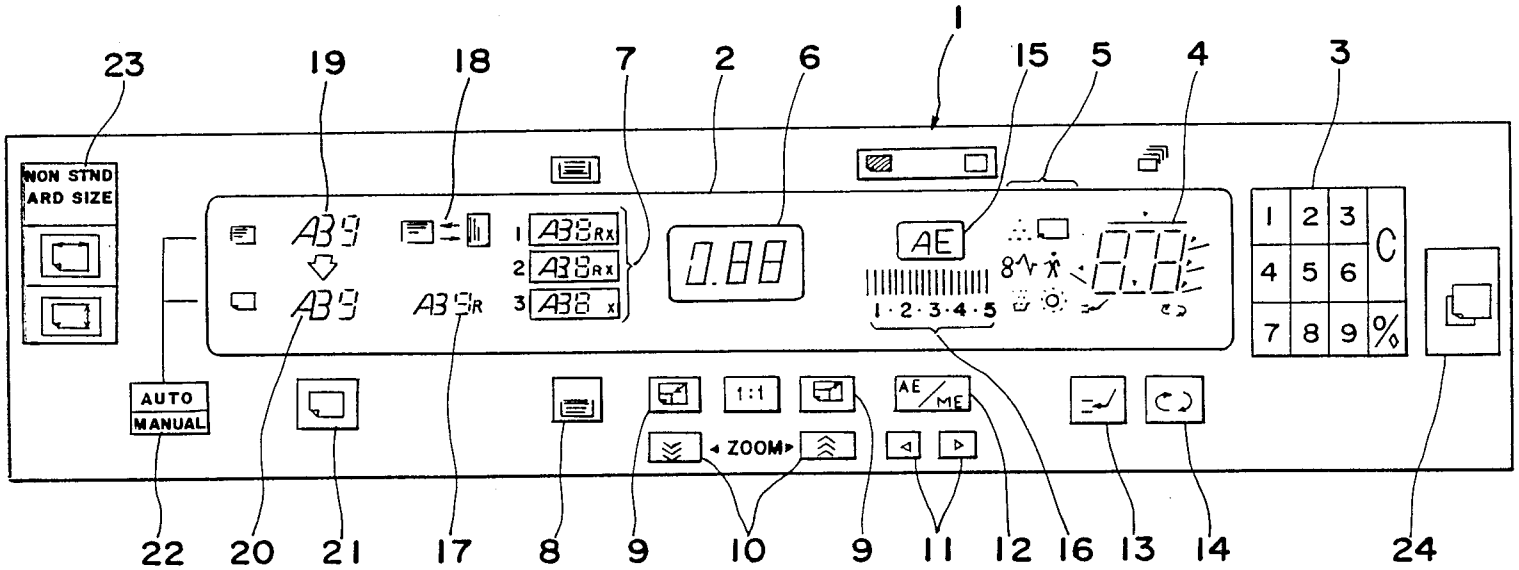
FIG. 4 is a view showing an operation part of the copying apparatus.
Figure 5:
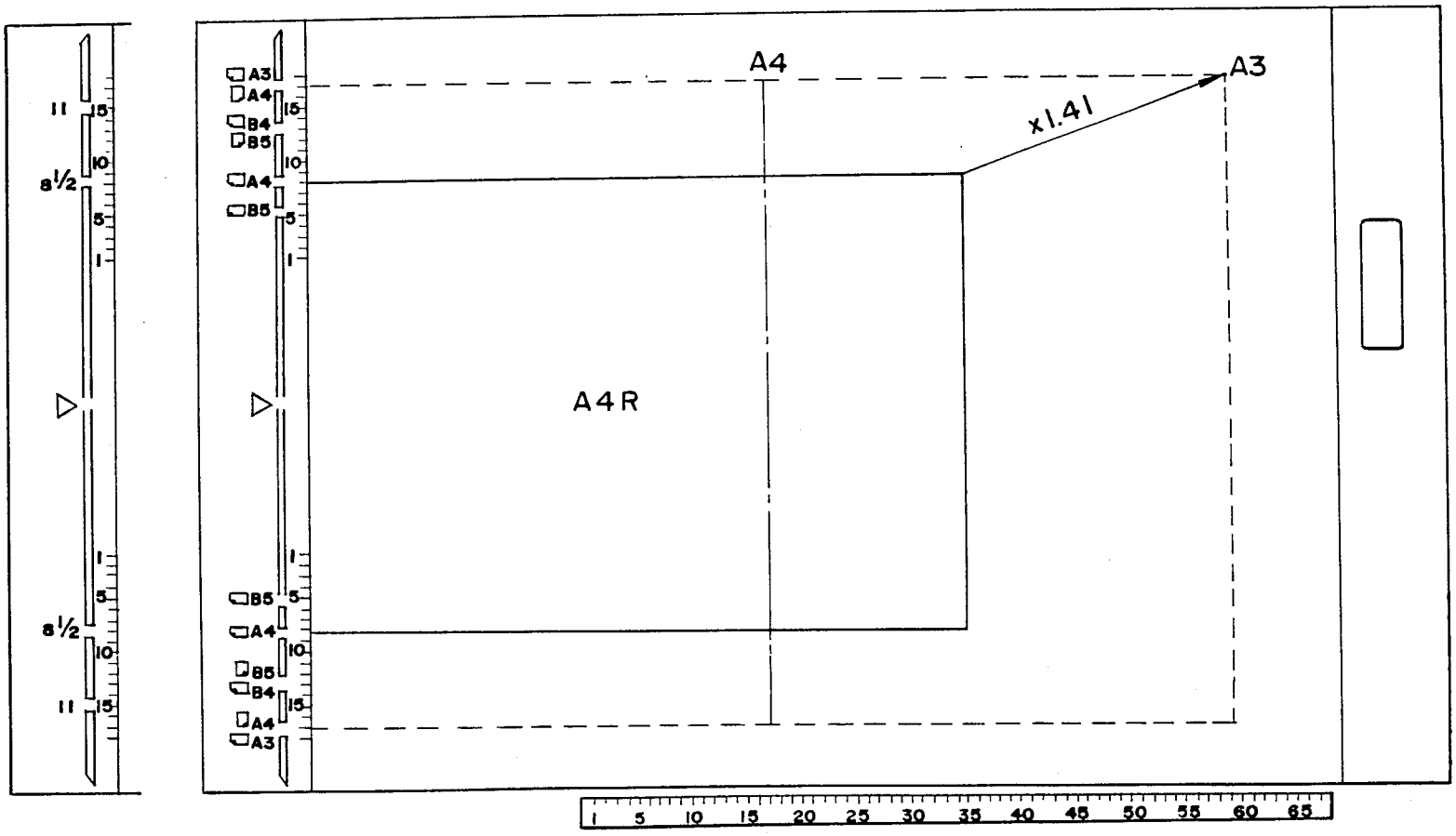
FIG. 5 is a view showing the condition how an original document is placed on an original document platform.

Referring to FIG. 4, there is seen an operation part of an electrophotographic copying apparatus provided with a selecting means of various magnification changing elements according to one preferred embodiment of the present invention.

An indication part 2 is arranged at an approximately the central portion on an operation part 1, with a ten-key control 3 and a copy button 24 positioned at the right side thereof. The ten-key control 3 is used to set the number of copy papers to be copied, and the copy button 24 starts the copying operation. An indicator 4 provided at the right end of the indication part 2 shows the number of copy papers to be copied inputted by the ten-key control 3. Below this indicator 4 are provided an interruption key 13 and a repeat key 14. A warning display 5 serves to inform an operator of the copying apparatus about an accident or an abnormal state in the copying operation, such as paper jamming, shortage of toner or the like by the use of respective sketches. An exposure indicator 16 for indicating the condition of the exposure during the copying operation shows the density of an image formed on the copy paper through operation of an exposure adjustment key 11 provided therebelow. When an automatic exposure mode is selected by the operation of an auto/manual selection key 12, an automatic exposure indication key 15 is lit, and an appropriate amount of exposure corresponding to the density of the original document is automatically selected. A magnification ratio indicator 6 provided at an approximately central portion of the indication part 2 indicates the magnification ratio during the copying operation which is changed by a fixed magnification selection key 9 and a zoom key 10 provided therebelow. A selected cassette indication member 7 is arranged leftward of the indicator 6 in order to indicate not only the respective size of the copy paper cassettes accommodated into three shelves in a copy paper supply part of the copying apparatus body (not shown), but also the selected cassette to be employed for the copying operation. A desired copy paper cassette can be manually selected by the operator through operation of a cassette selection key 8 positioned below the cassette indication member 7. The size of the original document and that of the copy paper to be employed for copying are respectively indicated on an original document size indicating member 19 and a copy paper size indicating member 20, both provided at the left end of the indication part 2. The original document size indicating member 19 indicates the size of the original document detected by a well-known original document size detecting device provided at the original document platform (not shown). On the other hand, the copy paper size indicating member 20 indicates the size of the copy paper selected through calculation with the use of the detected size of the original document and the inputted magnification ratio and through operation of a copy paper size selection key 21 provided below the copy paper size indicating member 20. A copy paper/magnification ratio selection key 22 is provided leftward of the indication part 2 in order to determine whether or not th magnification changing elements or factors obtained by the selecting means are valid, which selecting means calculates and selects a magnification ratio or the size of copy paper on the basis of the detected size of the original document and, the set size of the copy paper or the set magnification ratio. By switching this copy paper/magnification automatic selection key 22 for manual operation, the operator can manually input the size of the copy paper and the magnification ratio. The operation of a regular size original document input key 23 at the left end of the operation part 1 releases the operation of the original document size detecting means, and therefore, the operator should set the size of the original document through manual inputting. A non-cassette indicator 17 indicates the size of a required copy paper cassette in the case were the copy paper cassette of the size calculated and selected by the magnification changing elements selecting means is not accommodated in a cassette setting. Moreover, an indicator 18 embodying the indicating means which indicates the necessity for changing the direction of placement of the original document according to the present invention, instructing the change of the direction of the original document placed on the platform (not shown) when it is not appropriate with respect to the set magnification changing elements.

FIGS. 1(A)–(D) and FIGS. 2(A)–(D) are flow-charts respectively showing the operation of the copying apparatus equipped with the selecting means of magnification changing elements according to the preferred embodiment of the present invention. In the drawings, the size of an original document, the size of copy the paper, the size of a copy paper cassette and the magnification ratio are represented by reference A, B, C and D, respectively. Further, the magnification ratio D is represented by symbols corresponding to respective ratios shown in FIG. 3.

FIGS. 1(A)–(D) show a series of proceedings in the case where a magnification ratio is calculated and selected on the basis of the size of the copy papers selected by the operator and the size of the original document detected by the original document size detecting means.

In step n1 (hereinafter, the step n1 will be referred to only as n1), it is detected whether or not the size of the copy paper set by the operator is A3. In the case that the set size of the copy paper is A3, the flow proceeds to n2 where a copy paper cassette accommodating therein copy papers of A3 size is selected. Then, at n3, it is determined whether or not the size of the original document detected by the original document size detecting device is A3. In the case that the original document placed on the original document platform is A3, the flow goes to n6 where the magnification ratio D is set 24. Thereafter, at n11, it is decided whether or not the copy paper/magnification ratio automatic selection key 22 is turned on, and if it is found that the key 22 is not turned on, the flow proceeds from n11 to n14, then to n15 respectively in which the number of copy papers to be copied is set by the ten-key control 3 and the copy button 24 is turned on. In n16, the copying operation based on the elements set according to the foregoing proceedings is carried out. If the copy paper/magnification ratio automatic selection key 22 is turned on at n11, the flow runs to n12 where the size of the original document, the size of copy paper and the magnification ration all stored in the memory are cleared off. Then, the above magnification changing elements are inputted by the operator at n13, which n13 is followed by n14.

When it is detected at n3 that the size of the original document is not A3, the flow starts to n4 where it is determined whether or not the size of the original document placed on the platform is A4. If the answer is yes, the flow proceeds from n4 to n7. In the case where the size of the original document placed on the platform is A4, and the selected size of the copy paper is A3, two kinds of magnification ratios become possible by changing the direction of placement of the original document placed on the platform. In the above condition, when the smaller magnification ratio is used for copying, an image of the size equal to the original is formed on half the copy paper of A3 size, and therefore, a desired image cannot be obtained. For preventing such inconvenience as described above, the indicator 18 for changing the direction of the original document suggests the change of the direction of placement of the original document at n7. Next, the magnification ratio is set 4D at n8, which is followed by n11. In the case where the size of the original document is detected not to be A4 in n4, the flow advance to n5 where it is determined whether or not the size of the original document is B4. If the original document placed on the platform is determined to be B4 in n5, the flow proceeds to n9 where the magnification ratio is selected to be 33, and then to n11. On the contrary, if the size of the original document placed on the platform is decided not to be B4 at n5, then the size of the original document is determined to be B5 and the flow starts to n10 where the magnification ratio is changed to be 4D, succeeding to n11. When the original document of A3 size is selected in the aforementioned process, a magnification ratio is selected in accordance with the detected size of the original document.

In the case that the set size of the copy paper is not A3 at n1, the flow goes to n17 where it is detected whether or not the size of copy paper set by the operator is A4. If the set size of the copy paper is A4, n17 is succeeded by n18. When the size of the original document placed on the platform is A3, a copy paper cassette in which copy paper of A4 size are placed with their longitudinal direction parallel to the direction of supply of copy paper is selected in n19, and the magnification ratio is set 06 at n22. Thereafter, the flow continues to n11. In the case that the size of the original document is not A3 at n18, then the flow proceeds to n21. Further, in the case that the size of the original document is B4 at n21, the flow starts to n22 where the same copy paper cassette A4R as selected in n19 is selected, with the magnification ratio D being set 11 at n23, then proceeding to n11. If the size of the original document is not B4 at n21, the flow proceeds to n24. If the size of the original document is found to be A4 at n24, the flow goes to n25 where a copy paper cassette for A4 size is selected. And, at n26, the magnification ratio D is set 24, thereafter continuing to n11.

Meanwhile, if the size of the original document is detected not to be A4 at n24, the flow is directed to n27. At this time, if the longitudinal direction of the original document in A4 size is put in parallel relation to the exposure scanning direction, the flow goes from n27 to n28 where the copy paper cassette A4R is selected. The magnification ratio D is set 24 in n29, which step is followed by n11. On the contrary, if the size of the original document is not A4 at n27, the flow runs to n30 where it is detected whether or not the size of the original document is B5. In the case of the answer being in the affirmative at n30, the flow goes to n31 in which the copy paper cassette for A4 size is selected, and then to n32 where the magnification ratio D is set 33. Or, in the case of the answer being in the negative at n30, the flow proceeds to n33 where the copy paper cassette A4R is selected. An in n34, the magnification ratio D is set 33. Then the flow proceeds from n32 or n34 to n11 in respective cases. In the foregoing process, when copy paper of A4 size is selected, a magnification ratio corresponding to the respective size of the original documents is properly selected.

In the meantime, if the size of the copy paper is detected not to be A4 at n17, the flow proceeds to n35 where it is detected whether or not the size of the copy paper is B4. If the selected size of the copy paper is detected to be B4 at n35, then a copy paper cassette for B4 size is selected at n36, and it is determined at n37 whether or not the size of the original document is A3. If the size of the original document is A3, the flow goes to n38 where the magnification ratio D is set 16, further to n11. In the case that the size of the original document is detected not to be A3 at n37, the flow is directed to n39 at which it is detected whether or not the size of the original document is B4. If the answer is yes, the magnification ratio D is set 24 at n40, which step is followed by n11. If the answer is no at n39, then the flow passes to n41 where it is detected whether or not the size of the original document is A4. If the size of the original document is A4, the indicator 18 for changing the direction of the original document suggests at n43 that the direction of placement of the original document should be changed. Thereafter, the magnification ratio D is set 3A at n43, and the flow continues to n11. In the case that the size of the original document is found not to be A4 at n41, the flow goes to n44 where it is detected whether or not the original document placed on the platform is A4R. If the original document is A4R, the flow proceeds to n45 in which the magnification ratio D is set 3A, continuing to n11. On the other hand, if the original document is not A4R, the flow runs to n46 where it is detected whether or not the size of the original document is B5. If the answer is yes, the direction of placement of the original document is indicated to be changed by the indicator 18 at n47. Then, the flow proceeds to n48. If the size of the original document is detected not to be B5 at n46, in this case, the flow goes directly to n48 where the magnification ratio D is set 4D. Then, the flow continues to n11. In the above process, when copy papers of B4 size are selected, a magnification ratio corresponding to the respective size of the original documents can be selected.

When the size of the original document is not B4 at n35, the flow runs to n49 in which it is detected whether or not the size of the copy papers selected by the operator is B5. In the case that the selected size if B5 at n49, the flow goes to n50 where it is detected whether or not the size of the original document is B4. In the case that the size of the original document is B4, a copy paper cassette B5R is selected at n51, and the magnification ratio D is set 06 at n52. Then, the flow continues to n41. In the case that the size of the original document is not B4 at n50, the flow goes to n53 and it is detected whether or not the size of the original document is A4.

If the answer is yes, a copy paper cassette for B5 size is selected at n54, with the magnification ratio D being set 16 at n55. The flow continues to n11. If the size of the original document is found not to be A4 at n53, the flow runs to n56 where it is detected whether or not the original document placed on the platform is A4R. When the original document is detected to be A4R at n56, the flow proceeds to n57 where the copy paper cassette B5R is selected. And, the magnification ration D is set 16 at n58, which step continues to n41. In the case that the original document is found not to be A4R at n56, the flow goes to n59 where it is detected whether or not the size of the original document is B5. In the case of the answer being yes at n59, the copy paper cassette for B5 size is selected at n60. On the other hand, in the case of the answer being no at n59, that is, in the case that the size of the original document is not B5, the flow goes to n61 where the copy paper cassette B5R is selected, then to n62 where the magnification ratio D is set 24, further to n11. In accordance with the aforementioned process, when copy papers of B5 size are selected, a magnification ratio corresponding to the respective size of the original documents is selected.

In the foregoing process, n7, n42 and n47 are related to the original document placement direction changing means of the present invention.

FIGS. 2(A)-(D) are flow-charts showing the proceedings in the case where proper copy paper is selected with the use of the magnification ratio determined by the operator and the size of the original document detected by the original document size detecting device. In step s1 (hereinafter, step s1 will be referred to only as s1), it is detected whether or not the size of the original document placed on the platform is A3. In the case of the answer being in the affirmative, the step proceeds to s2 in which it is detected whether or not the set magnification ratio is larger than 16. If the set magnification ratio is larger than 16, a copy paper cassette for A3 size is selected at s3, which step is followed by s7. If the set magnification ratio is smaller than 16 at s2, the step goes to s4 where it is detected whether or not the magnification ratio is larger than 06. In the case that the magnification ratio set at s4 is larger than 06, the step goes to s5 where the copy paper cassette for B4 size is selected, while, in the case that the magnification ratio is smaller than 06, the step proceeds to s6 where the copy paper cassette A4R is selected. Then, the step continues to s7 in the above two cases. By the above-described process, when the original document of A3 size is placed on the platform, a proper copy paper cassette for the size corresponding to the set magnification ratio is selected.

In the meantime, when the size of the original document is not A3 at s1, the step goes to s13 where it is detected whether or not the detected size of the original document is A4. If the size of the original document is detected to be A4 at s13, the step proceeds to s14 at which it is detected whether or not the set magnification ratio is larger than 24. In the case that the magnification ratio is larger than 24, the indicator 18 for changing the direction of the original document suggests the change in the direction of placement of the original document at s15, and the copy paper cassette for A3 size is selected at s16. Then, the step continues to s7. If the magnification ratio is smaller than 24 at s14, the step goes to s17 where it is detected whether or not the magnification ratio is larger than 16. In the case that the magnification ratio is larger than 16, the copy paper cassette for A4 size is selected at s18. On the contrary, if the magnification ratio is smaller than 16, the copy paper cassette for B5 size is selected at s19, and then the step continues to s7. In accordance with the above process, when the original document of A4 size is placed on the platform, a proper copy paper cassette for the size corresponding to the set magnification ratio is selected.

Further, when the size of the original document is not A4 at s13, the step goes to s20 where it is detected whether or not the size of the original document is B4. The step proceeds to s21 when the size of the original document is B4, and it is detected there whether or not the set magnification ratio is larger than 24. If the magnification ratio larger than 24 is selected, the copy paper cassette for A3 size is selected at s22. Then, the step continues to s7. Meanwhile, when the magnification ratio is less than 24 at s21, the step is directed to s23 in which it is detected whether or not the magnification ratio is larger than 11. If the magnification ratio is set larger than 11, the copy paper cassette for B4 size is selected at s24, and the step advances to s7. In the case that the magnification ratio is less than 11 at s23, the step goes to s25 where it is detected whether or not the magnification ratio is over 06. If the answer is yes, the copy paper cassette for A4R is selected at s26. Or, if the answer is no, a copy paper cassette B5R is selected at s27. Thereafter, in both cases, the step continues to s7. In the process as described hereinabove, when the original document of B4 size is placed, a copy paper cassette for the size corresponding to the set magnification ratio can be selected.

The step proceeds from s20 to s28, if the size of the original document is not B4, and in which it is detected whether or not the size of the original document placed on the platform is B5. In the case that the size of the original document is B5, the step proceeds to s29 where it is detected whether or not the magnification ratio is more than 33. If the set magnification ratio is more than 33, the change in the direction of placement of the original document is suggested by the indicator 18 at s30. In s31, the copy paper cassette for A3 size is selected, which step is followed by s7. If the magnification ratio is smaller than 33 at s29, it is detected at s30 whether or not the ratio is more than 24. And, if the magnification ratio is over 24, the step advances to s33 where the copy paper cassette for A4 size is selected. On the contrary, if the magnification ratio is smaller than 24, the copy paper cassette for B5 lize is selected at s34. Then, the step continues to s7 in both cases. In the above process, when the original document of B5 size is placed on the platform, a copy paper cassette for the size corresponding to the set magnification ratio can be selected.

In the case that the size of the original document is detected not to be B5 at s28, the step goes to s35 in which it is detected whether or not the original document is A4R. If the original document is A4R, the step goes from s35 to s36 where it is detected whether or not the set magnification ratio is more than 3A, then to s37, if the magnification ratio is over 3A, where the copy paper cassette for A3 size is selected. Further, the step continues to s7. If the magnification ratio is less than 3A at s36, the step proceeds to s38 where it is detected whether or not the magnification ratio is over 24. If the set magnification ratio is over 24, the copy paper cassette for B4 size is selected at s39. Then, the step continues to s7. If the set magnification ratio is less than 24 at s38, the step runs to s40 and it is detected whether or not the magnification ratio is over 16. In the case that the magnification ratio is over 16, the copy paper cassette A4R is selected in s41, while, in the case that the magnification ratio is less than 16, the copy paper cassette B5R is selected at s42. In both cases as described above, the step continues to s7.

According to the aforementioned process, when the original document of A4size is placed in such manner that its longitudinal direction be in parallel relation to the exposure scanning direction, a copy paper cassette of the size corresponding to the set magnification ratio is selected.

When the original document placed on the platform is not A4R in s35, then the step proceeds to s43 where it is detected whether or not the magnification ratio is over 33. If the set magnification ratio is over 33, the copy paper cassette for B4 size is selected at s45, which step is succeeded by s7. If the magnification ratio is detected to be less than 33 at s43, it is detected at s46 whether or not the ratio is over 24. And, if the magnification ratio is over 24, the copy paper cassette A4R is selected at s47. Or, if the magnification ratio is less than 24, the copy paper cassette B5R is selected at s48. Thereafter, the step flows to s7. By the foregoing process, when the original document of B5 size is placed with its longitudinal direction parallel to the exposure scanning direction, a copy paper cassette of the size corresponding to the set magnification ratio is selected.

In s7, it is detected whether or not the copy paper/-magnification ratio auto-selection key 22 is turned on. When the key 22 is turned on, the magnification changing elements such as the size of the original document, the size of copy papers and the magnification ratio determined in accordance with the above-described proceedings are cleared off. Thereafter, all of the magnification changing elements are manually inputted by the operator in s9, which step proceeds to s10. Meanwhile, when the copy paper/magnification ratio auto-selection key 22 is not turned on in s7, the step advances directly to s10 where the number of copy papers to be copied is determined. Then, after the copy button is turned on at s11, the copying operation is started at s12.

In the above-described operation, s15 and s30 are related to the indicating device for changing the direction of placement of the original document according to the present invention.

By the foregoing operation according to the present invention, the best magnification ratio can be selected, with correction of improperness of the direction of placement of the original document when the size of the copy paper is set. Moreover, a copy paper cassette for the best size can also be selected in the same manner as above even when the magnification ratio is set. As a result, therefore, an erroneous copying operation due to the improperness of the direction of placement of the original document can be prevented.

It is to be noted here that if a copy paper cassette selected in the above process is not ready in the cassette setting, the size of the necessary copy paper is indicated in the non-cassette indicator 17.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic copying apparatus comprising in combination an original document size detecting means for detecting size of an original document placed on an original document platform, a selecting means of various magnification changing elements which calculates and selects, on the basis of the size of said original document detected by said original document size detecting means and a predetermined size of copy paper or a predetermined magnification ratio, a proper magnification ratio when the size of said copy paper is predetermined, or a proper size of copy paper when the magnification ratio is predetermined, and an indicating means which indicates the necessity to change the direction of placement of said original document such that the magnification ratio is larger or the image forming area does not exceed the size of the copy paper in the case when either or both of said original document and/or copy paper are capable of being placed in such a manner that a longitudinal direction thereof is brought in either a crossing or parallel relation with respect to an exposure scanning direction.

* * * * *